US008016508B2

(12) United States Patent
Byun

(10) Patent No.: US 8,016,508 B2
(45) Date of Patent: Sep. 13, 2011

(54) DISCHARGE STRUCTURE OF THE COSMETIC BRUSH

(76) Inventor: Young Kwang Byun, Seoul (KR)

( * ) Notice: Subject to any disclaimer, the term of this patent is extended or adjusted under 35 U.S.C. 154(b) by 210 days.

(21) Appl. No.: 12/518,337

(22) PCT Filed: Jan. 15, 2007

(86) PCT No.: PCT/KR2007/000233

§ 371 (c)(1),
(2), (4) Date: Jun. 9, 2009

(87) PCT Pub. No.: WO2008/088093

PCT Pub. Date: Jul. 24, 2008

(65) Prior Publication Data

US 2010/0021229 A1 Jan. 28, 2010

(51) Int. Cl.
*A47L 13/22* (2006.01)

(52) U.S. Cl. ..... 401/286; 401/272; 401/273; 401/278

(58) Field of Classification Search ..... 401/272, 401/273, 278, 279, 286, 288
See application file for complete search history.

(56) References Cited

U.S. PATENT DOCUMENTS

| | | | | |
|---|---|---|---|---|
| 4,944,625 | A | 7/1990 | Futter et al. | |
| 5,092,702 | A * | 3/1992 | Kurokawa | 401/279 |
| 6,206,600 | B1 * | 3/2001 | Rosenberg et al. | 401/272 |
| 6,363,948 | B2 | 4/2002 | Choi | |
| 6,558,061 | B2 | 5/2003 | Petit | |
| 2005/0188999 | A1 | 9/2005 | Byun | |

FOREIGN PATENT DOCUMENTS

| | | | |
|---|---|---|---|
| JP | 2007008551 | A | 1/2007 |
| KR | 0253672 | A | 10/2001 |
| KR | 1020050082547 | A | 8/2005 |

(Continued)

OTHER PUBLICATIONS

Korean Intellectual Property Office As the International Searching Authority, International Search Report for International Application No. PCT/KR2007/000233, Oct. 11, 2007.

(Continued)

*Primary Examiner* — David Walczak
(74) *Attorney, Agent, or Firm* — Momkus McCluskey, LLC; Jefferson Perkins

(57) ABSTRACT

As an inner moving body of a cosmetic brush is pushed, an upper cone type elastic part and a lower cone type elastic part are compressed, thereby opening an inner hole and discharging powder toward a brush. When the inner moving body is released, the inner moving body returns to its original position by the elasticity of a spring inserted around the circumference of a middle member and by expansive force of the upper cone type elastic part and the lower cone type elastic part. An inner hole is closed by a sealing sill formed on circumference of a sealing pin so that powder is not discharging. Thereby, the brush can control the amount of powder to be discharged with the spring inserted around the circumference of a middle member and the expansive force of the upper cone type elastic part and the lower cone type elastic part which are formed on the middle member. In addition, when the supply of powder in the inner moving body is exhausted, the supply of powder can be filled by opening the inner moving body, as assembling and disassembling of the middle member and the inner moving body can be done with ease.

2 Claims, 7 Drawing Sheets

FOREIGN PATENT DOCUMENTS

| | | | |
|---|---|---|---|
| KR | 1020050087508 | A | 8/2005 |
| KR | 1020070019290 | A | 2/2007 |
| KR | 1020070019291 | A | 2/2007 |
| KR | 100705690 | B1 | 3/2007 |
| KR | 1020070040058 | A | 4/2007 |
| KR | 1020070047864 | A | 5/2007 |
| KR | 1020070092087 | A | 9/2007 |
| KR | 1020090029344 | A | 3/2009 |

OTHER PUBLICATIONS

Korean Intellectual Property Office As the International Searching Authority, Written Opinion of the International Search Authority, Oct. 11, 2007.

* cited by examiner

[Fig. 1]
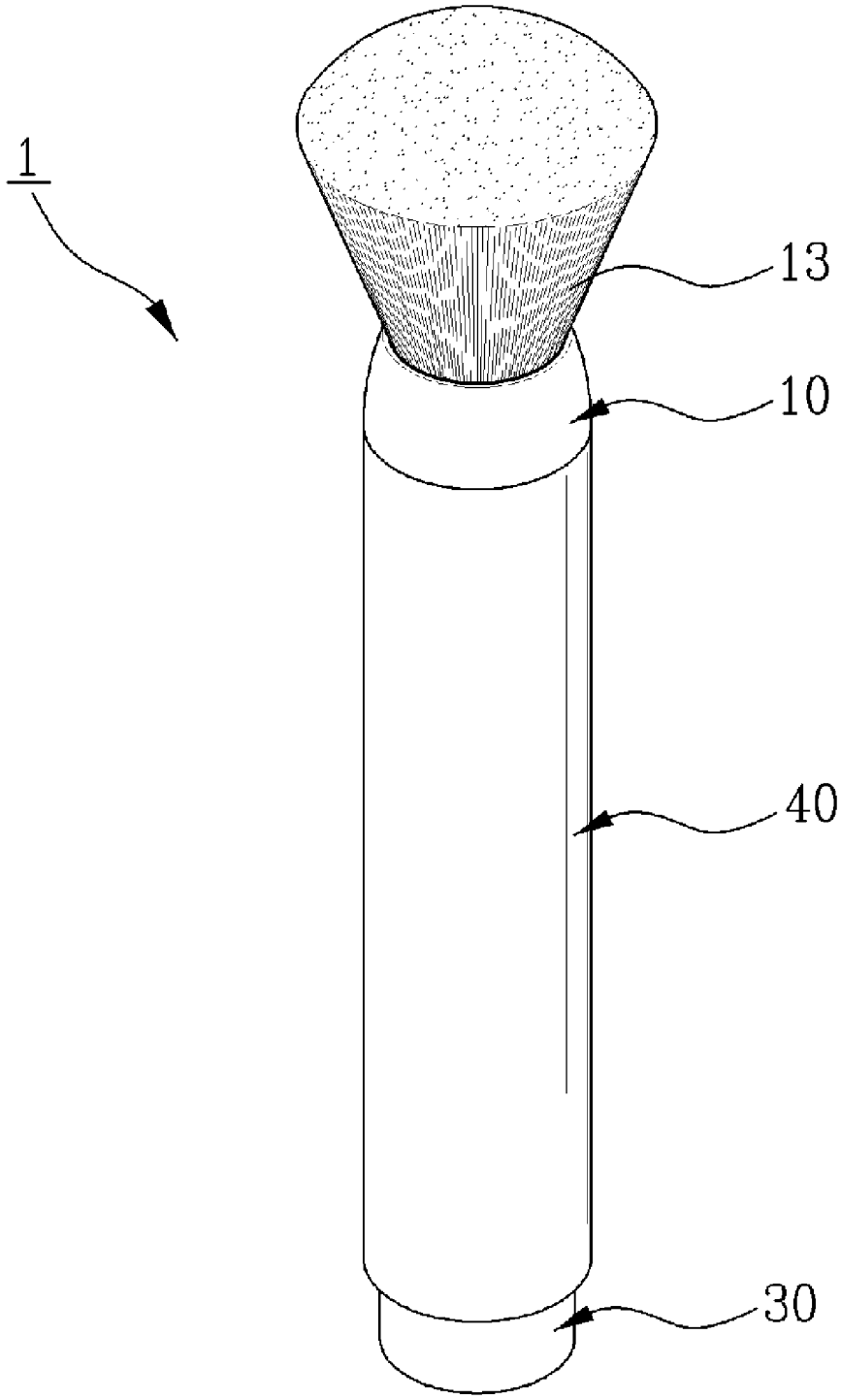

[Fig. 2]
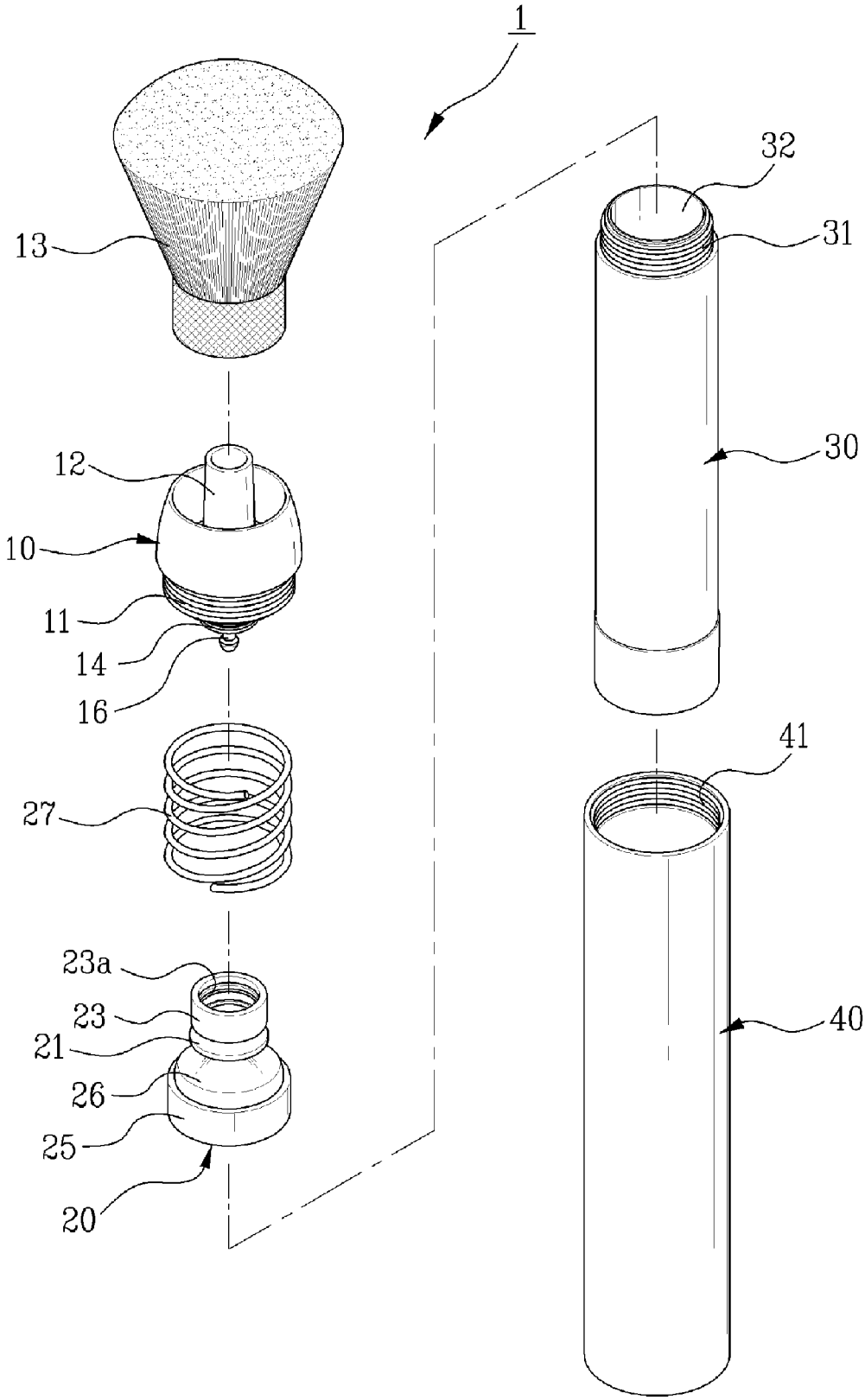

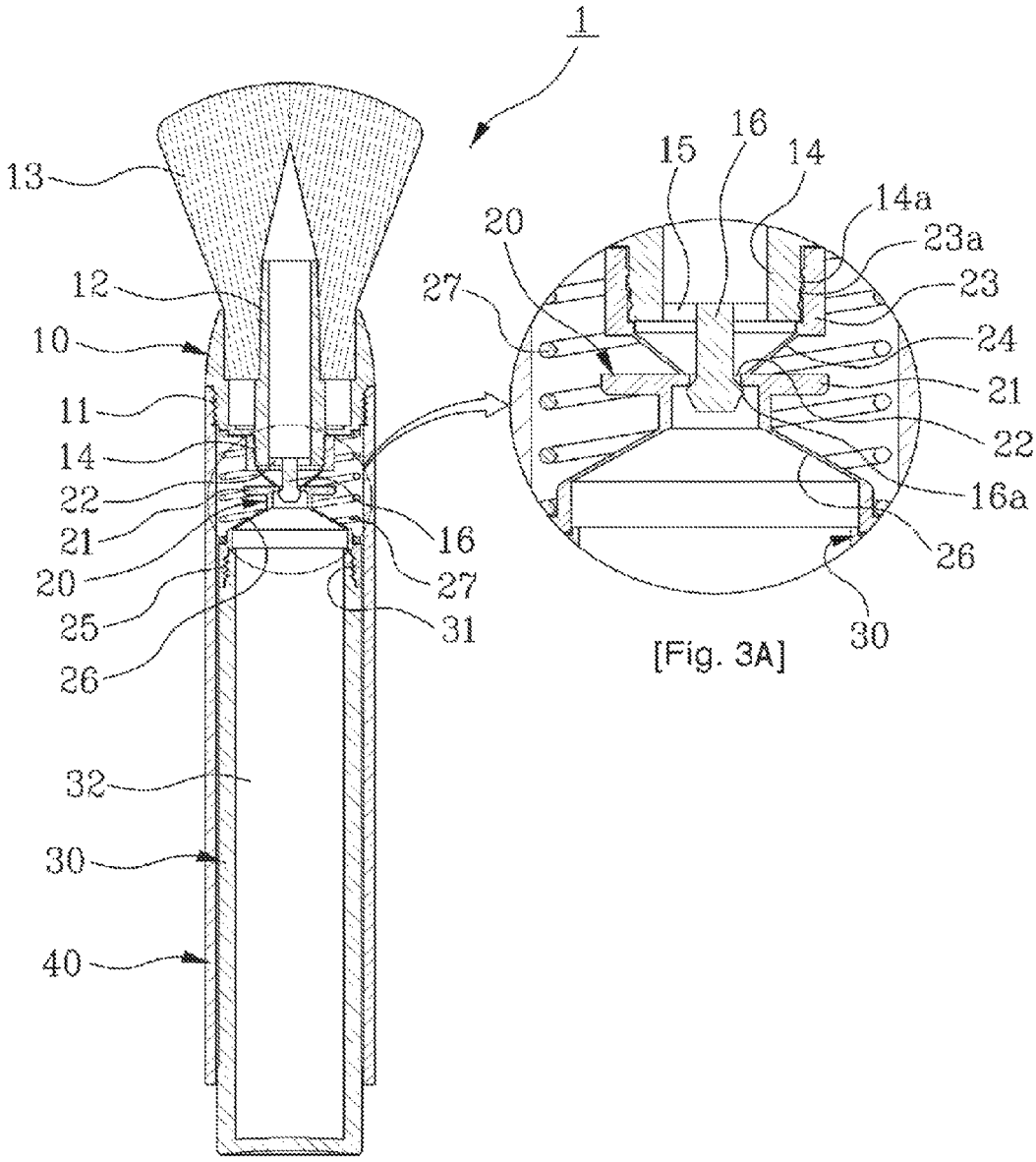
[Fig. 3A]
[Fig. 3]

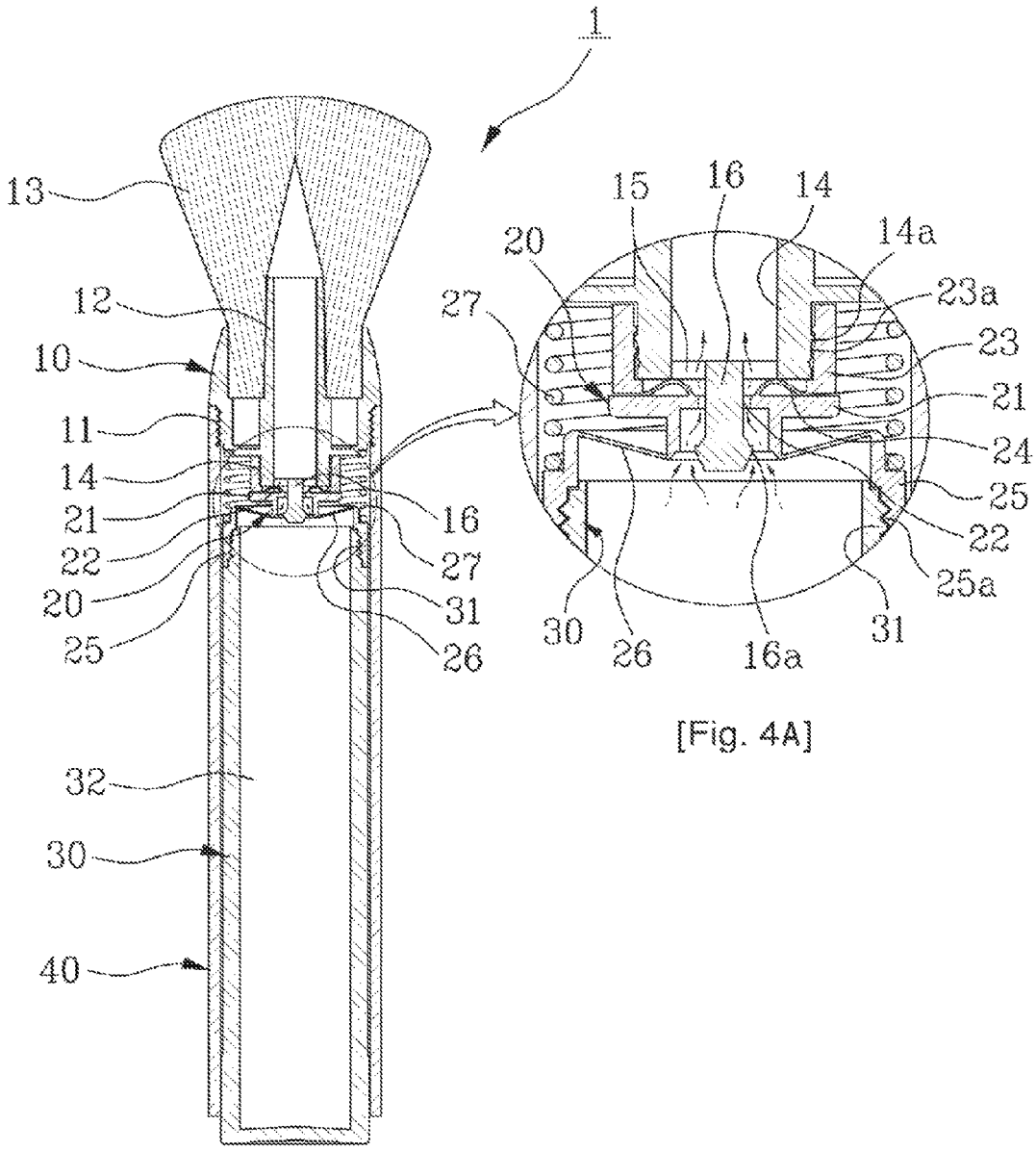
[Fig. 4A]
[Fig. 4]

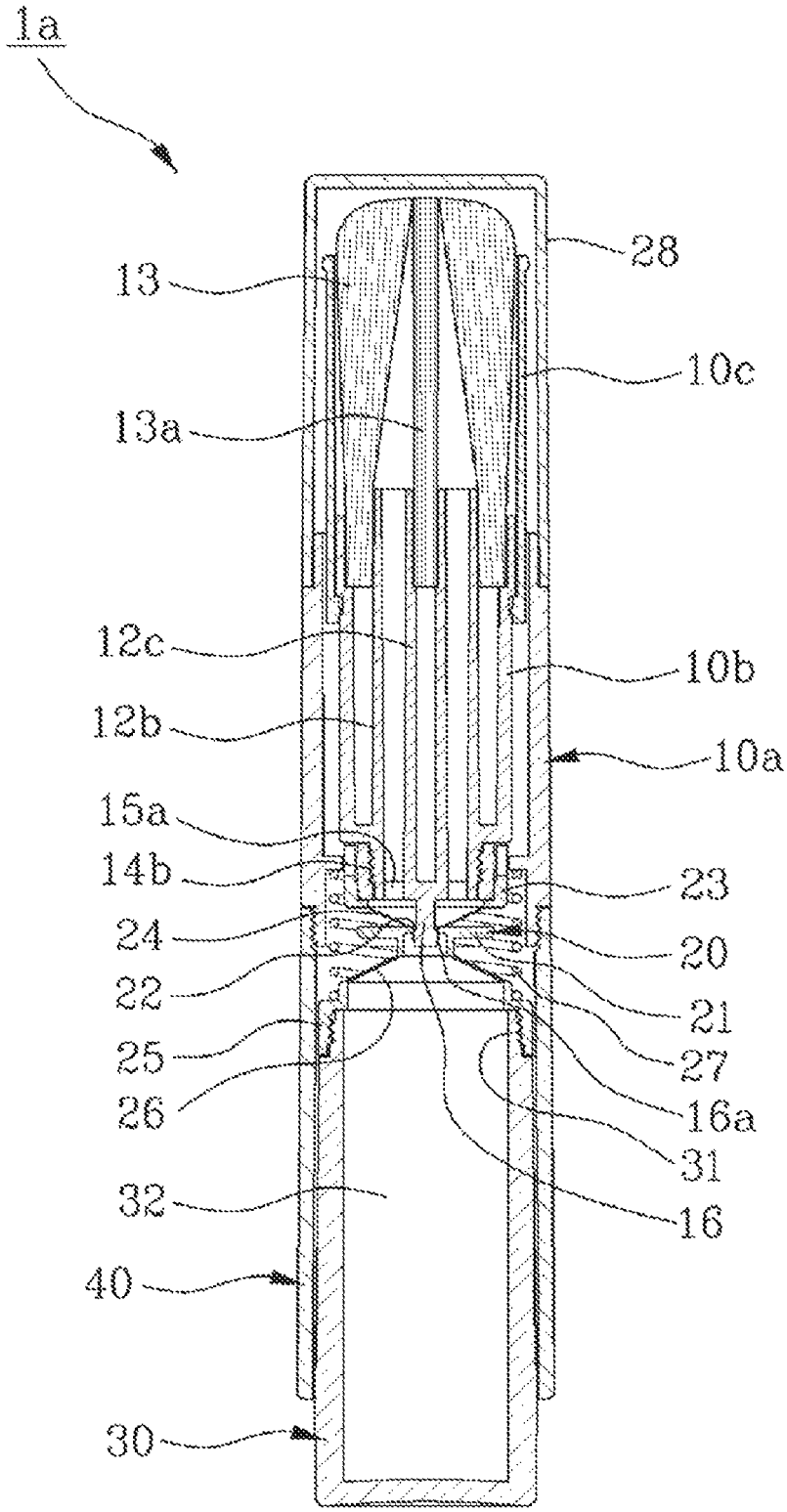
[Fig. 5]

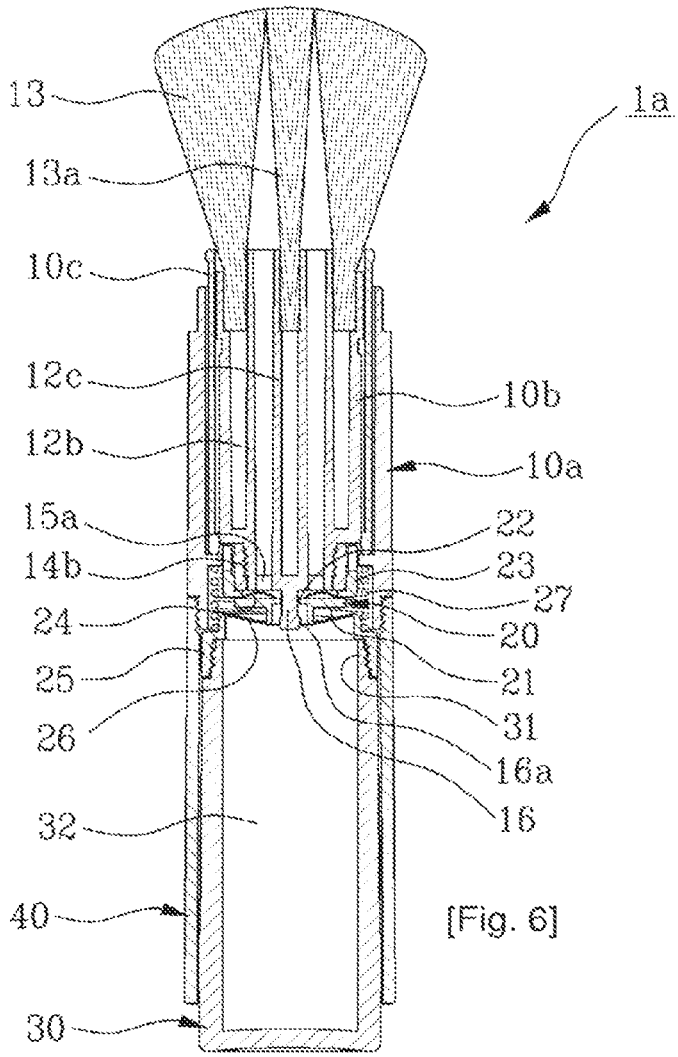
[Fig. 6]
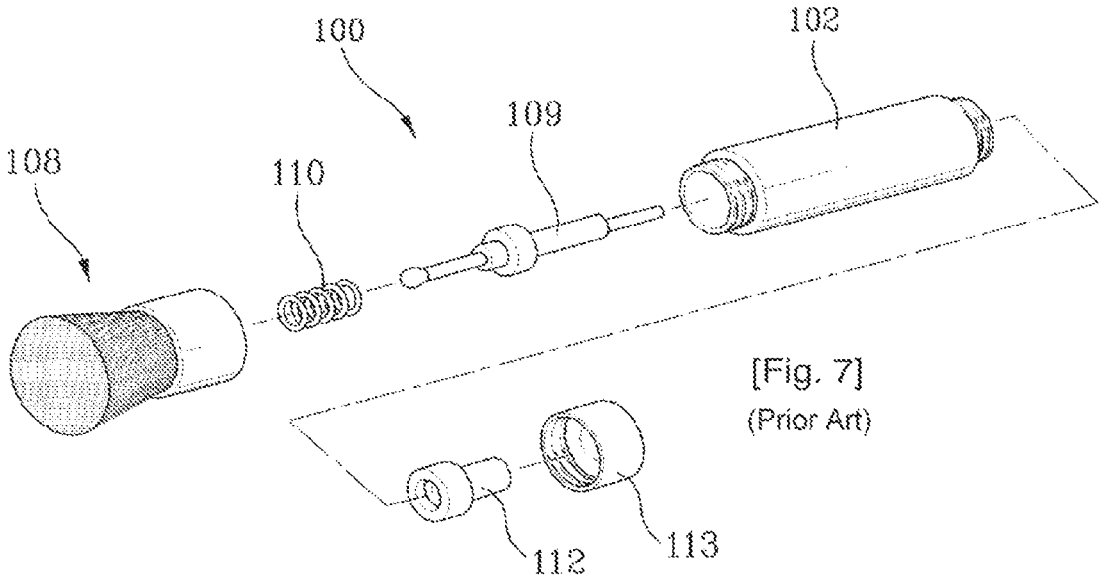
[Fig. 7]
(Prior Art)

[Fig. 8]
(Prior Art)
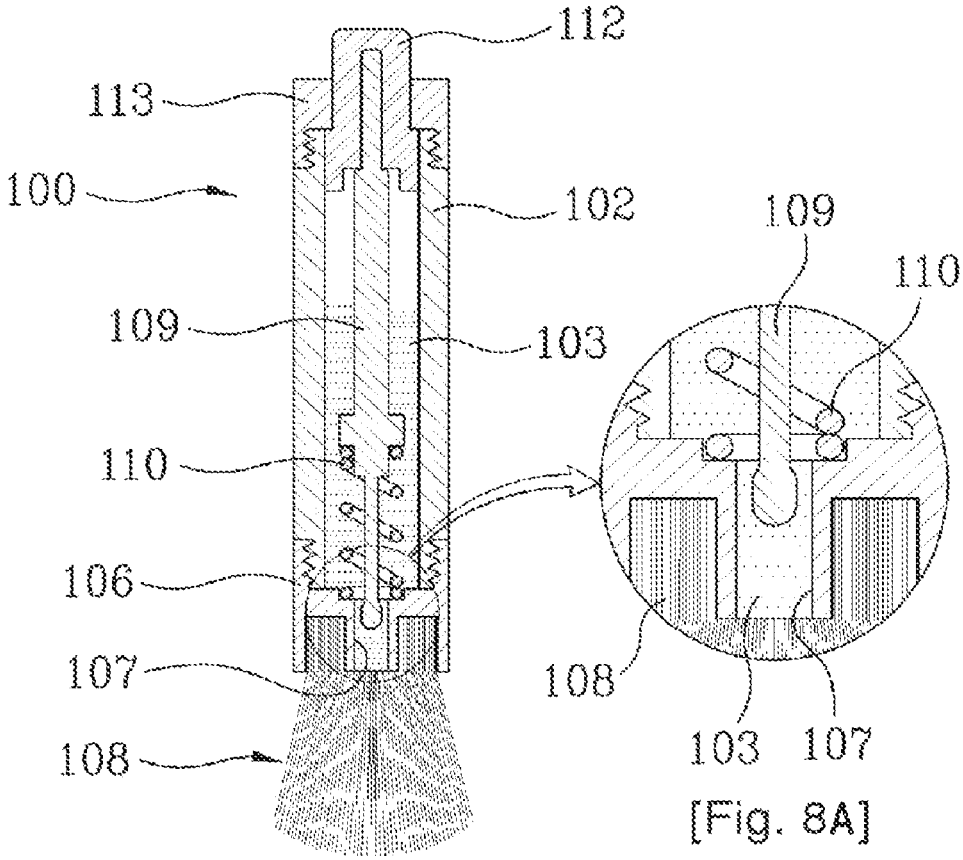
[Fig. 8A]

DISCHARGE STRUCTURE OF THE COSMETIC BRUSH

TECHNICAL FIELD

The present invention relates to a discharge structure of a cosmetic brush. More particularly, as an inner moving body is pushed, an upper cone type elastic part and a lower cone type elastic part are compressed, thereby opening an inner hole and discharging powder toward a brush. When released, an inner moving body returns to its original position through the elasticity of a spring inserted around a middle member and by the expansive force of the upper cone type elastic part and the lower cone type elastic part. This closes an inner hole with a sealing sill formed on circumference of a sealing pin so that the powder does not discharge. Thereby, the brush can control the amount of powder being discharged by means of the spring and by the expansive force of the upper cone type elastic part and the lower cone type elastic part, which are formed on the middle member. In addition, when the supply of powder in the inner moving body is exhausted, the supply of powder can be refilled by opening the inner moving body, since assembling and disassembling of the middle member and the inner moving body can be done with ease.

BACKGROUND ART

In general, cosmetics are classified into solid states or liquid states that are mixed with a liquid. In recent years, cosmetics like lipsticks or foundation creams are supplied in liquid form for the user's convenience. In some cosmetic cases, after being filled with liquid cosmetics, the cosmetics in the case are discharged to the brush by rotating a certain part of the case.

The conventional cosmetic brush integrates the body and the brush but requires that the powder be applied to the brush separately. As such, it is inconvenient to carry and keep the powder and the brush separately.

According to Korean Patent Registration No. 0,253,672, a cosmetic brush having a bottle-shaped body receives powder inside. The powder in the body is discharged toward the brush under air pressure in order to apply the powder. As shown in FIG. 7 and FIG. 8, an upper part and a lower part of the cosmetic brush are open tubes. A first body 102 receives the cosmetic powder 103 inside, and a second body 106 is threaded onto an outer circumference of the first body 102. The second body 106 includes a discharge hole 107 formed in the center of the second body 106 and a brush 108 surrounds the discharge hole 107 and is connected to the rest of the second body 106 at an inner fore part, or channel. A pin 109 has forward and rearward sections and a spring 110 is coiled around the outer circumference of the forward section. The forward end may be inserted through the discharge hole 107 of the second body 106 and the spring 110 seats around the discharge hole 107 of the second body 106. A rearward end of the spring 110 seats against a lip of the pin 109. A top cap 113 is threaded onto the other end of the first body 102, and in conjunction with a button 112 supports the rearward section of the pin 109.

According to the structure above, when using the cosmetic brush 100, a user pushes the button 112, moving the pin down and supplying the cosmetic powder 103 in the body 102 to the brush 108 via the discharging hole 107. The user may then release the button 112 and the spring 110 moves the pin 109 upward toward its original position.

The cosmetic powder 103 discharging to the brush 108 via the discharging hole 107 is supplied to the brush 108 by the forward section of the pin 109 directly penetrating through the discharging hole 107.

Two disadvantages with the conventional cosmetic brush as described above are that the powder 103 discharges to the brush 108 in an irregular manner and that the powder 103 discharges to the brush 108 when the cosmetic brush 100 itself is shaken.

In addition, the button 112 formed on the top cap 113 may be hit by other belongings or an external force may be applied while carrying the brush, causing the powder 103 to discharge to the brush 108 and damaging other belongings. In the event that the brush 100 is kept in a humid place or has not been used for a long period of time, the powder 103 in the first body 102 and left in the discharging hole 107 may aggregate, or clump, and therefore will not discharge smoothly.

SUMMARY OF THE INVENTION

The present invention has been conceived to solve the conventional problems. It provides a cosmetic brush, which, as an inner moving body is pushed, an upper cone-type elastic part and a lower cone-type elastic part are compressed, thereby opening an inner hole and discharging powder toward a brush. When the upper cone-type elastic part and the lower cone type elastic part are uncompressed, the inner moving body returns to its place by the action of a spring coiled around a base of a middle member and by the expansive force of the upper cone-type elastic part and the lower cone-type elastic part. This closes an inner hole with a sealing sill formed on a sealing pin 16 so that powder does not discharge. Thereby, the brush can control the amount of powder to be discharged by means of a spring coiled around a middle member and by the expansive force of the upper and lower cone-type elastic parts formed on the middle member. In addition, when the supply of powder in the inner moving body is exhausted, it can be refilled by disassembling the middle member and the inner moving body to open the inner moving body.

BRIEF DESCRIPTION OF THE DRAWINGS

FIG. 1 is a perspective view according to one embodiment of the present invention.

FIG. 2 is an exploded perspective view of the brush in FIG. 1.

FIG. 3 is a cross-sectional view of one embodiment of the present invention.

FIG. 3*a* is an inset showing the upper and lower cone type elastic parts in an uncompressed, or expanded, condition.

FIG. 4 is a cross-sectional view of the embodiment in FIG. 3.

FIG. 4*a* is an inset showing the upper and lower cone type elastic parts in a compressed condition.

FIG. 5 is a cross-sectional view according to another embodiment, showing the upper and lower cone type elastic parts in an uncompressed, or expanded, condition.

FIG. 6 is a cross-sectional view of the embodiment in FIG. 5 showing the upper and lower cone type elastic parts in a compressed condition.

FIG. 7 is an exploded perspective view of a brush according to the prior art.

FIG. 8 is a cross-sectional view of a brush according to the prior art.

FIG. 8*a* is an inset of the cross-sectional view of the brush in FIG. 8.

Hereinafter, the present invention will be described in detail with reference to the accompanying drawings.

DETAILED DESCRIPTION

FIG. 1 is a perspective view of the present invention, FIG. 2 is an exploded perspective view of the brush in FIG. 1. FIG. 3 is a cross-sectional view of one embodiment of the present invention with an inset showing the upper and lower cone type elastic parts in an uncompressed, or expanded, condition.

FIG. 4 is a cross-sectional view of the embodiment in FIG. 3 with an inset showing the upper and lower cone type elastic parts in a compressed condition.

The cosmetic brush 1 comprises a top moving body 10, a middle member 20, an inner moving body 30, and an outer moving body 40. A brush 13 may be inserted onto the top moving body 10. The top moving body 10 has threads 11 formed on the outer circumference and a powder transporting tube 12 formed radially inwardly from the threads. The brush 13 may be inserted over the powder transporting tube 12.

A mating tube 14 includes a sealing pin 16, a through hole 15, and a sealing sill 16*a* on the sealing pin 16, where the sealing sill 16*a* is formed between the lower part of the powder transporting tube 12 and a chamber 32 of the inner moving body 30.

An upper coupling member 23 of the middle member 20 is inserted onto the mating tube 14 and is connected to the upper cone-type elastic part 24. A middle plate 21 of the middle member 20 connects the upper cone type elastic part 24 the lower cone type elastic part 26, and an inner hole 22 is formed in the center part inside of the middle plate 21. A lower coupling member 25 is connected to the lower cone-type elastic part 26.

A spring 27 is coiled around the middle plate 21 and the inner moving body 30 includes an upper outer thread 31, which may be screwed to the lower coupling member 25 of the middle member 20. See FIG. 2. The outer moving body 40 includes an upper inner thread 41 that may be screwed to the outer threads 11 of the upper moving body 10.

In use, when the inner moving body 30 is pushed, the upper cone type elastic part 24 and the lower cone type elastic part 26 are compressed, thereby opening an inner hole 22 and discharging powder toward a brush 13. When released, the inner moving body 30 returns to its place by the elasticity of the spring 27 coiled around the middle member 20 and by the expansive force of the upper cone type elastic part 24 and the lower cone type elastic part 26. This closes the inner hole 22 with a sealing sill 16*a* formed on the sealing pin 16 so that powder cannot discharge, and the brush can control the amount of powder to be discharged by means of the spring 27 and the expansive force of the upper cone type elastic part 24 and the lower cone type elastic part 26.

ADVANTAGEOUS EFFECTS

The present invention is that, as an inner moving body is pushed, an upper cone type elastic part and a lower cone type elastic part are compressed. Thereby, an inner hole is opened and powder is discharged toward a brush. Thereafter, an inner moving body returns to its place through the action of the spring coiled around the middle member, and by the expansive force of the upper cone type elastic part and the lower cone type elastic part. The inner hole is closed by a sealing sill formed on the sealing pin 16 so that powder does not discharge, thereby controlling the amount of powder to be discharged. The spring coiled around the middle member and the expansive force of the upper cone type elastic part and the lower cone type elastic part formed on the middle member aid in returning the middle member to the uncompressed condition. In addition, when the supply of powder in the inner moving body is exhausted, the supply of powder can be refilled by disassembly of the middle member and the inner moving body to open the inner moving body.

BEST MODE FOR CARRYING OUT THE INVENTION

One embodiment of the present invention as illustrated in FIGS. 1 to 4, composes a top moving body 10, a middle member 20, an inner moving body 30 and an outer moving body 40. The top moving body 10 has threads 11 formed on the outer circumference. A powder transporting tube 12 for transporting powder to a brush 13 is formed inwardly from the threads 11, and a brush 13 may be inserted around the powder transporting tube 12. A through hole 15 which passes powder to the tube 12 is formed in the lower part of the powder transporting tube 12. A mating tube 14 includes a sealing pin 16 having a sealing sill 16*a* formed at the bottom of the powder transporting tube 12.

Circumferential ridges 14*a* may be formed on the outer circumference of the mating tube 14.

An upper coupling member 23 of the middle member 20 is connected to the lower part of the top moving body 10. The middle member 20 includes the middle plate 21 having an inner hole 22 in the middle thereof, an upper coupling member 23 formed by an upper cone type elastic part 24, and a lower coupling member 25 formed by a lower cone type elastic part 26.

Therefore, the middle member 20, as formed above, is connected to the lower part of the top moving body 10. A spring is inserted and affixed around the middle member 20 before the top movable body 10 is threaded into place.

Circumferential ridges 23*a* are formed in the inside of the upper coupling member 23, and the upper coupling member 23 is inserted onto the outer circumference of the mating tube 14 by compression, thereby mating the ridge 23*a* formed on inner circumference of the upper coupling member 23 the ridge 14*a* formed on the outer circumference of the mating tube 14, so they are securely combined with each other.

Threads 25*a* are formed in the inside of the lower coupling member 25, such that the inner moving body 30 having powder may be screwed to it.

The outer moving body 40 has upper inner threads 41 which are screwed to the threads 11 of the top moving body 10. The middle member 20 and the inner moving body 30 are screwed together to complete the cosmetic brush 1 of the present invention.

One embodiment of the present invention is illustrated in FIG. 3. The cosmetic brush 1 of the present invention is normally in the uncompressed state in which force is not applied to the lower part of the inner moving body 30. FIG. 3 denotes that the inner moving body 30, which interacts with the lower part of the top moving body 10 via the middle member 20, is in the state of being uncompressed, or down.

As shown in the inset of FIG. 3, the sealing pin 16 formed in the lower part of the powder transporting tube 12 in the top moving body 10 closes the inner hole 22 with the sealing sill 16*a*. If the lower part of the inner moving body 30 is pushed, the upper cone type elastic part 24 and the lower cone type elastic part 26 compress, thereby allowing the inner moving body 30 to move within the outer moving body 40.

Therefore, as the inner moving body 30 slides, the middle plate 21 is also moves as is illustrated in FIG. 4. The inner hole 22, which is closed by the sealing sill 16*a* of the sealing pin 16, separates from the sealing sill 16*a* and opens, thereby compressing the spring 27 formed around the circumference of the middle member.

If the user holds the cosmetic brush 1 upside down in a compressed condition such that the inner hole 22 is open, the user can apply makeup, as the powder in a receiving chamber 32 of the inner moving body 30 is discharged toward the brush 13, passing through the inner hole 22, through hole 15, and through the powder transporting tube 12. This flow path is indicated by the arrows in the inset of FIG. 4. The powder discharging toward the brush 13 can be discharged smoothly and evenly by enlarging the diameter of the powder transporting tube 12 positioned in the brush 13.

Therefore, after applying the makeup, if the force pressing the inner moving body 30 is released, the upper cone type elastic part 24 and the lower cone type elastic part 26 expand, and the inner moving body 30 returns to its uncompressed condition and the inner hole 22 formed in the middle of the middle plate 21 is closed by the sealing sill 16*a* of the sealing pin 16, which prevents the powder from discharging to the brush 13. It also prevents powder from leaking when not in use.

The spring 27 disposed around the circumference of the middle member 20 is elastic, which helps the upper cone type elastic part 24 and the lower cone type elastic part 26 expand and helps the inner moving body 30 return to its original position.

Therefore, by pressing and releasing the inner moving body 10, the upper cone type elastic part 24 and the lower cone type elastic part 26 are compressed and expanded, thereby opening and closing the inner hole 22. When the user pushes the inner moving body 30 to apply makeup, the inner hole 22 opens and the powder can be easily discharged. When the force applied to the inner moving body 30 is released, the inner hole 22 closes.

Since the middle member 20 is screwed to the inner moving body 30, the inner moving body 30 can be filled when powder in the inner moving body is exhausted by unscrewing the inner moving body 30 from the middle member 25.

For convenience, the drawing of the present invention shows the brush 13 facing upward, however the brush 13 is facing downward when in use.

ALTERNATIVE MODE FOR THE INVENTION

FIGS. 5 and 6 are cross-sectional views of another exemplary embodiment according to the present invention.

The discharging structure of the cosmetic brush 1 composes the middle member 20, the inner moving body 30, and the outer moving body 40. A brush cover 10*c* and an inner top moving body 10*b* are attached to the inside of the top moving body 10*a*, which is attached to an upper coupling member 23. As above, the upper coupling member is formed on the upper part of a middle member 20.

The upper part of the middle member 20 attaches to a mating tube 14*b* having a through hole 15*a* formed in the lower part thereof. An auxiliary brush insert tube 12*c* forms a wall of a powder transporting tube 12*b*. As shown in FIGS. 5 and 6, an auxiliary brush 13*a* is inserted into the auxiliary brush insert tube 12*c* and is positioned radially inwardly from the powder transporting tube 12*b*.

The inner top moving body 10*b* has a sealing pin 16 with a sealing sill 16*a* formed in the lower part of the auxiliary brush inserting tube 12*c*. The brush cover 10*c* may be joined to the inner top moving body around the circumference of the inner top moving body 10*b*.

In another embodiment, the brush 13 and the auxiliary brush 13*a* are inserted on the upper part of the upper coupling member 23 formed as a part of the middle member 20 of the present invention. The brush cover 10*c* and the inner top moving body 10*b* have the powder transporting tube 12*b* and the sealing pin 16 is combined with the top moving body 10*a*.

The mating tube 14*b* may be formed in the lower part of the inner top moving body, which is screwed to a radially inward portion of the top moving body 10*a*. The brush cover 10*c* is positioned inward of the inner circumference of the inner top moving body 10*b*, such that the brush cover 10*c* slides up and down between the top moving body 10*a* and the inner top moving body 10*b*.

The sealing pin 16 formed in the lower part of the inner top moving body 10*b* is inserted into the inner hole 22 that is formed in the middle part of the middle member 20.

According to another exemplary embodiment the cosmetic brush 1 includes powder in a receiving chamber 32 of the inner moving body 30, which is discharged to the brush 13 by pressing the lower part of the inner moving body 30. The powder passes through the inner hole 22, the through hole 15*a* and the powder transporting tube 12*b*.

Here, an auxiliary brush 13*a*, which may be inserted into the top of the auxiliary brush inserting tube 12*c* and is positioned vertically in the middle part of the inner top moving body 10*b*, uniformly distributing powder to the brush 13.

In addition, the brush cover 10*c* encases the brush 13 and is attached to the inner top moving body 10*b*. A cap 28 can be attached to the top of the top moving body 10*a* with ease.

Accordingly, the cosmetic brush 1*a* of FIGS. 5 and 6 is similar to the cosmetic brush 1 of FIGS. 1-4, in which as an inner moving body 30 is pushed, an upper cone type elastic part 24 and a lower cone type elastic part 26 are compressed, thereby opening an inner hole 22 and discharging powder toward the brush 13.

When the inner moving body 30 is released, the inner moving body 30 returns to its place through the elasticity of a spring 27 inserted around the middle member 20 and by the expansive force of the upper cone type elastic part 24 and the lower cone type elastic part 26. The inner hole 22 is closed by a sealing sill 16*a* formed on the circumference of the sealing pin 16 so that the powder does not discharge. Thereby, it can control the amount of powder to be discharged by means of the spring 27 inserted around the middle member 20 and by expansive force of the upper cone type elastic part 24 and the lower cone type elastic part 26 formed as a part of the middle member 20.

In addition, when supply of powder in the inner moving body 30 is exhausted, it can be filled by opening the inner moving body 30, since assembling and disassembling of a middle member 20 and an inner moving body 30 can be done with ease.

The invention claimed is:

1. A cosmetic brush comprising:

a top moving body having an outer thread on the outer circumference, a powder transporting tube formed inwardly of the thread, and mating tube including a through hole and a sealing pin having a sealing sill;

a middle member connected to the mating tube, in which an upper coupling member of the middle member connects to an upper cone type elastic part and a lower coupling member of the middle member connects to a lower cone type elastic part, an inner hole being formed in a center part inside of a middle plate;

a brush affixed to the top moving body;

a spring formed around the circumference of the middle plate;

an inner moving body including an upper outer thread threadably engaged with the lower coupling member; and an outer moving body having an upper inner thread threadably engaged with the outer thread of the top moving body.

2. The brush of claim 1, wherein the through hole is formed in the lower part of the mating tube, an auxiliary brush inserting tube is positioned in the middle part of the top moving body for attachment of an auxiliary brush such that the powder transporting tube and the auxiliary brush are positioned radially inwardly of the top moving body, and the top moving body is attached to brush cover.

* * * * *